US005401031A

United States Patent [19]

Kuna et al.

[11] Patent Number: 5,401,031

[45] Date of Patent: Mar. 28, 1995

[54] STRATEGY ATTACK GAME

[75] Inventors: Wayne A. Kuna, River Forest; Ralph J. Kulesza, Chicago, both of Ill.

[73] Assignee: Wayne Kuna & Associates, Oak Park, Ill.

[21] Appl. No.: 195,116

[22] Filed: Feb. 14, 1994

[51] Int. Cl.[6] ..... A63F 3/00

[52] U.S. Cl. ..... 273/265

[58] Field of Search ..... 273/242, 243, 265, 255, 273/262

[56] References Cited

U.S. PATENT DOCUMENTS

| | | | |
|---|---|---|---|
| 1,932,524 | 10/1933 | Jackson | 273/265 X |
| 3,149,842 | 9/1964 | Cirrincione | 273/265 |
| 3,401,936 | 9/1968 | Greenberg | 273/265 |
| 3,514,110 | 5/1970 | Thomander | 273/265 |
| 4,502,689 | 3/1985 | Al-Harari | 273/265 |
| 4,801,148 | 1/1989 | Lamb | 273/265 X |
| 5,154,428 | 10/1992 | Woolhouse | 273/265 |

FOREIGN PATENT DOCUMENTS

| | | | |
|---|---|---|---|
| 718991 | 1/1932 | France | 273/265 |
| 2387065 | 12/1978 | France | 273/265 |
| 1560473 | 2/1980 | United Kingdom | 273/265 |

*Primary Examiner*—William E. Stoll

*Attorney, Agent, or Firm*—Dick and Harris

[57] ABSTRACT

A strategy attack game including two consoles separated by an opaque shield and each having two 10×10 hole screens. Each console is also provided with one or two smaller, 7×7 screens that are movable with respect to the 10×10 screens. Players are provided with a fighter plane target token, an attack token and a number of tracer tokens. Each player attacks in turn using a movable screen to find the exact coordinates of the opponent's target token. In an attack, a movable smaller screen is positioned by its centermost hole on each side of the console at an attacker selected coordinate. Should that centermost location coincide with the target token, a direct hit is scored and the game is won. The movable screen has concentric bands of holes in defined outer, inner and innermost zones. If the target token is within any of the three zones, the attacked player must advise the attacking player of the target token's location and then move the target. Movement of the target token is limited by the zone in which the target token is found. Previous positions of the target token are marked by the tracer tokens and the attacked player is not permitted to again occupy a previous position. If the target token is not within any of the zones of the movable screen, the attacked player need not identify its location and it may be moved to any new, previously unoccupied position.

10 Claims, 1 Drawing Sheet

STRATEGY ATTACK GAME

BACKGROUND OF THE INVENTION

1. Field of the Invention

This invention relates generally to games and more particularly to strategy games in which one player attacks the target of another player.

2. Background Art

Games in which one player attacks or attempts to locate a target playing piece of an opposing player have long been popular pastimes. One particular game of this type is the Milton Bradley "Battleship" game which is available in two versions, one of which includes accompanying sounds to simulate the sounds of a navel battle to further entertain and amuse the players. In the "Battleship" game, each player is provided with corresponding target and attack screens that are preferably hidden from the view of the opposing player. Each screen has a corresponding matrix providing a predetermined number of peg hole positions. In addition, each player is provided with four target tokens of differing size that are positioned upon the target screen in any preselected positions. The target tokens then remain in such positions until the conclusion of the game. Players take turns calling out attack coordinates. The attacked player merely responds whether there has been a "hit" or a "miss" at that coordinate. Different colored pegs are used by the attacking player to record the "hit" or "miss" on the attack screen. The object of the game is "sink" all of the opposing player's target ships. The "Battleship" game, which has long provided much entertainment and amusement, was created in and reflects a more slow moving era of warfare than the present in which battle is engaged between airplanes moving at supersonic speeds and having electronic equipment capable of zeroing in on their targets. Accordingly, there is also a need for a strategy attack game and a device facilitating its play that more closely reflects the battles of today in which players may learn more in response to an attack than merely whether it has resulted in a "hit" or a "miss" and to provide for movability of the targets.

SUMMARY OF THE INVENTION

The present invention is concerned with providing a strategy attack game including two consoles with each console having at least one screen containing a matrix of a predetermined number of positions. An opaque screen shields the view of each console from the opponent. At least two movable screens, each having a matrix of a smaller number of positions than the predetermined number and being movable with respect to the screens having the matrix of a predetermined number of positions are also provided. Each console is additionally provided with at least one target token, at least one attack token and a preselected number of tracer tokens. The movable screens are divided into zones with each zone containing a concentric band of positions. Each player attacks in turn using a movable screen to find the exact coordinates of the opponent's target token. During an attack, the movable screen is positioned by its centermost hole on each side of the console at an attacker selected coordinate. If the target token is within any of the zones, the attacked player must advise the attacker of the target token's location and then move the target. Limitations on movement of the target token correspond to the zone in which the target token is found. Previous positions of the target token are marked by the tracer tokens and the target token may not be moved back to a previously occupied position. If the target token is not within any of the zones of the movable screen, the attacked player need not identify the target token's location and it may be moved to any new, previously unoccupied position.

BRIEF DESCRIPTION OF THE DRAWINGS

For a better understanding of the present invention, reference may be had to the accompanying drawings in which.

DETAILED DESCRIPTION

Figure 1:
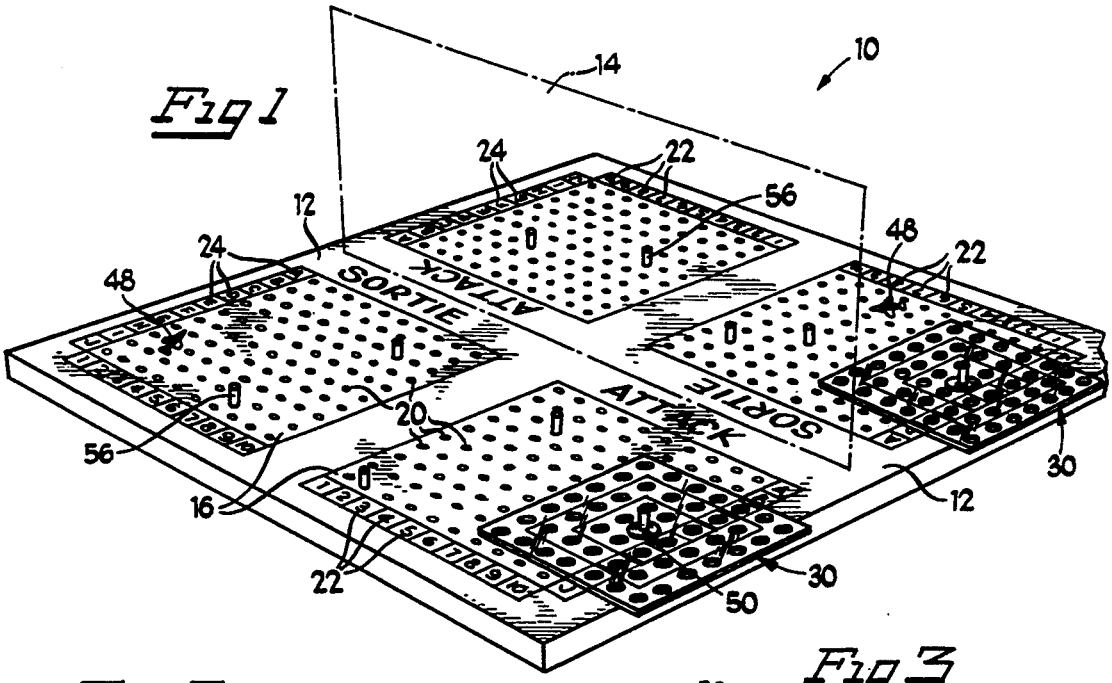
FIG. 1 is a perspective view of an embodiment of the present invention.
Figure 2:
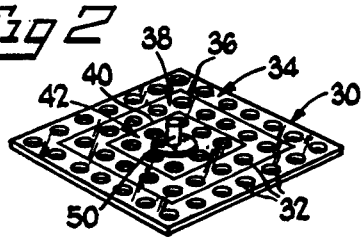
FIG. 2 is a perspective view of the smaller, movable screen portion of the present invention.
Figure 4:
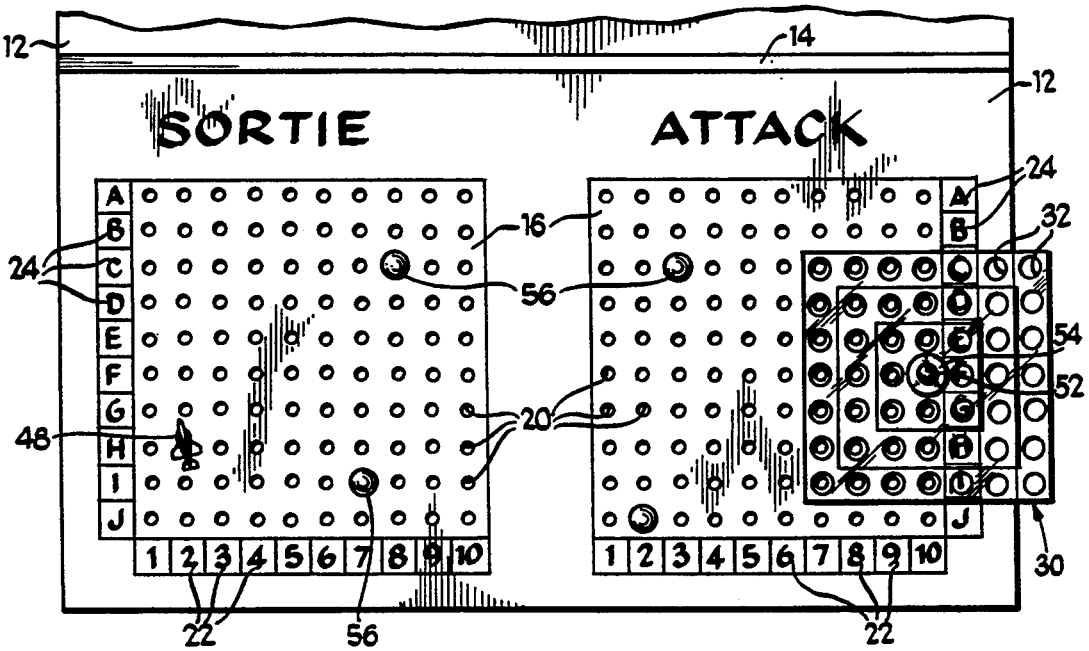
FIG. 4 is a fragmentary, enlarged scale top plan view of one of the consoles of the present invention.

Referring now to the drawings in which like parts are designated by like reference numerals throughout the several views, there is shown in FIG. 1 a game 10 including a pair of opposing consoles 12 separated by an opaque shield 14 which obstructs the view from one console to the other. Both consoles 12 include a pair of side-by-side screens 16 each having a matrix with a predetermined number of regularly spaced apart positions, which in the embodiment shown is a $10\times10$ matrix. Conveniently, as is illustrated in FIGS. 1 and 4, the screen on the player's left is designated as the "SORTIE" screen, while the other screen on the player's right is designated as the "ATTACK" screen. Screens 16 may be fixed or stationary with respect to their respective consoles.

Each screen 16 is provided with a series of numerals 22, from one to ten in the embodiment shown in the drawings, along the abscissa with each number corresponding to a column of positions or holes 20. Similarly, each stationary screen 16 is provided with a series of alphabet letters 24, from A to J in the embodiment shown in the drawings, along the ordinate with each letter of the alphabet corresponding to a row of positions or holes 20. The numerals and the letters correspond to the same respective columns and rows on each screen. Accordingly, any particular position on any screen may be identified by giving its abscissa and ordinate coordinates. For example, in the screens shown in FIG. 4, "A-1" identifies the uppermost and leftmost position on each of the screens. As is apparent from FIG. 1, the same "A-1" coordinates would identify the same uppermost and leftmost position on the two screens facing the player on the opposite console.

Game 10 also includes radar screens 30 that are movable with respect to screens 16 and are preferably, though not necessarily, formed of a transparent or translucent lightweight plastic. Movable screens 30 have a matrix of holes 32 that are generally of the same circular shape as holes 20 but are of a slightly greater diameter. The centers of holes 32 are equally spaced apart in the same pattern as the centers of holes 20 of stationary screens 16. However, the matrix of movable screen 30 has a lesser number of total holes or positions than on the stationary screen. In the embodiment shown in the drawings, the movable screen matrix is 7×7 while the fixed or stationary screen matrixes are 10×10.

The positions or holes 32 of movable screen 30 are in concentric bands. Thus, the outer edge of movable screen 30 defines a third or outer zone 34 together with a demarcation 36, conveniently in the form of a molded ridge or indentation or a colored line. Zone 34 includes the outer band of 7×7 columns and rows of the matrix. In addition, demarcation 36 defines an inner 5×5 band of a second or inner zone 38 together with demarcation 40. Similarly, an innermost 3×3 band of a first or innermost zone 42 is defined by demarcation 40 and the centermost position or hole 44 of movable screen 30. Centermost hole 44 is called the "LOCK-ON" position.

Each player could be provided with just one movable screen. However, as an alternative, each player could be provided with a set of two such movable screens, one for attacking the opponent and the other for gauging the opponent's attack. In such a case, the two movable screens in each set could be distinguished from each other by color or some other graphic indicia.

In addition, each player is provided with at least one target token 48, which as illustrated in the drawings is conveniently formed in the shape of a fighter plane and an attack token 50 conveniently in the form of a peg with an upwardly projecting handle portion 52 above a flange 54. Also provided to each player are a plurality of tracer tokens or pegs 56.

Figure 3:
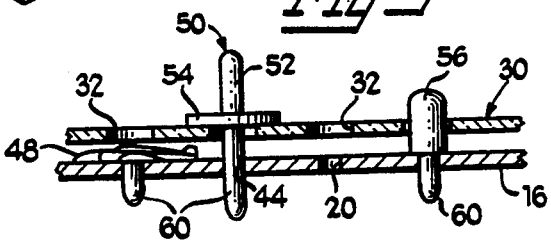
FIG. 3 is a fragmentary, enlarged scale generally vertical sectional view taken through one of the screens of the present invention.

As is best illustrated in FIG. 3, token 48, attack token 50 and tracer tokens 56, all have a downwardly depending peg portion 60 which fits into and is received in one of the holes 20 in stationary screens 16 to removably mount the tokens in a particular position. The dependent portion 60 of attack token 50 also passes through centermost hole 44 of movable screen 30, and then fits into a selected one of the holes in a screen 16. As illustrated in FIG. 3, target tokens 48 are conveniently formed to provide for positioning of movable screen 30 over them. While only the dependent peg portion 60 of tracer tokens 56 fit into holes 20 of screens 16, the upper portion also fits through the larger diameter holes 32 of movable screen 30.

If desired, all of the tokens could be in the same general shape as attack token 50 and merely be distinguished by color to identify a target token and tracer tokens. In such a case, handle portion 52 of token 50 would be of the same shape and size as depending portion 60 so that on the target and tracer pegs, the upwardly projecting handle portion would fit through holes 32 on movable screen 30 should it be necessary to place the movable screen over them. As yet a further alternative, the target and tracer tokens could be in the shape of a flat head or button peg. In such an alternative, the target and tracer tokens would be distinguished by color or some other readily identifiable graphic means on the head of the token. To facilitate use by each player of only one movable screen 30, one of the tracer tokens could be further distinguished by color or other graphic indicia to mark the immediate last known position of the opponent's target token.

At the beginning of play, each player places the player's respective target token 48 in any selected position on the player's SORTIE screen. The players then decide by any suitable conventional means who will attack first. The attacking player begins an attack sequence by placing the center of movable screen 30 anywhere the attacking player selects on the "ATTACK" screen and telling the attacked player the position of the center or "LOCK-ON" hole coordinate. The attacked player then overlays that player's "SORTIE" screen with a movable screen by placing an attack token 50 through the centermost hole 44 of movable screen 30. Should the attacking player call out the coordinates of the other player's target token, the attacked player calls "LOCK-ON" indicating that a direct hit has been scored and the attacking player wins. It will be appreciated that with a 10×10 matrix, the odds of the attacking player scoring such a direct at the onset of the game are relatively small.

If the attacked target token is outside of the 7×7 range of the radar or movable screen 30, the attacked player is permitted to move the target token to any new location on the 10×10 matrix of the stationary "SORTIE" screen leaving a tracer token 56 to mark the abandoned position. However, if the target token is within the 7×7 range of the movable screen, the attack player must advise the attacking player of the relative accuracy of the attacking player's lock-on.

When the target token is only within outer 7×7 zone 34, the attacked player responds "Level 3 LOCK-ON" and gives the exact coordinates of the target token. The attacked player must then move the target token anywhere up to three positions within the 7×7 matrix of movable screen 30. Each player then marks the previous position of the target token with a tracer token 56.

In the event that the target token is within inner second zone 38 of movable screen 30, the attacked player responds "Level 2 LOCK-ON" and gives the exact coordinates. The attacked player must then move the target token up to two positions within the twenty-five holes of 5×5 matrix, which include the sixteen holes of the band and the nine holes surrounded by zone 38. Again, both players mark the previous position of the target token with a tracer token 56.

Should the attack target token be within innermost first zone 42, the attacked player responds "Level 1 LOCK-ON" and gives the exact coordinates. The attacked player must then move the target token one hole within the holes of the 3×3 matrix, which include the eight holes in the band and the centermost hole surrounded by the innermost zone. Each player marks the previous coordinates with a tracer token.

At no time during the game may the attacked player move the target to a previously occupied position, that is one that is marked by a tracer token. Upon completion of an attack sequence, the players can reverse roles and proceed as indicated above. Play alternates until one player executes a successful "LOCK-ON" to win the game. It will be appreciated that even when the attacked target is within the innermost zone of the radar screen, the attacking player may in a subsequent attack sequence relocate the radar screen such that the target token is now within a larger zone permitting greater movement and facilitating the possibility of evasion by the target token. If in a subsequent attack sequence, the attacking player's radar screen 30 is positioned such that it no longer covers the attacked target token, the attacked player has successfully evaded attack and does not then have to indicate the new coordinates.

While one particular embodiment of the invention has been shown and described with some suggested alternatives, further variations and modifications will occur to those skilled in the art. For example, this game, like the "Battleship" game, may be provided with electronic sounds to simulate the sounds of a radar screen operating, fire against the target and explosion should "LOCK-ON" occur. It is intended in the appended claims to cover all such variations and modifications as fall within the true spirit and scope of the present invention.

What is claimed is new and desired to be secured by Letters Patent is:

1. A method of playing a game between two or more players comprising the steps of:

providing each player with a console having two or more screens of a first size and one or more screens of a second size movable with respect to the screens of the first size with each screen of the first size having a matrix of a predetermined number of positions and each screen of the second size having a matrix of positions less than the predetermined number, one or more target tokens, one or more attack tokens and a number of tracer tokens;

having each player initially position the target token on any of the predetermined number of positions on one screen of the first size;

selecting a player to attack first;

initiating the attack by having the player selected to go first advising the player whose target token is being attacked of the one of the predetermined number of positions that is being attacked;

declaring the attacking player to be the winner if the attacked position coincides with the position of the target token;

positioning an identified position of the screen of the first size to coincide with the attacked position;

moving the target token anywhere within the matrix of positions of the screen of the first size if the target token is not within the matrix of positions of the screen of the second size; and instructing the attacking player of the location of the target token if the target token is within the matrix of the screen of the second size.

2. The method of playing a game as defined in claim 1 including the step of limiting movement of the target token to a first maximum number of positions if the target token location is within the matrix of positions of the screen of the second size.

3. The method of playing a game of claim 1 including the step of limiting movement of the target token to a position within the matrix of positions of the screen of the second size if the target token location is within the matrix of positions of the screen of the second size.

4. The method of playing a game as defined in claim 1 comprising further steps of:

defining an outer zone of positions and an inner zone of positions on the one or more screens of a second size;

limiting movement of the target token to the first maximum number of positions if the target token location is within the outer zone of positions of the matrix of positions of the screen of the second size; and limiting movement of the target token to a second maximum number of positions if the target token location is within the inner zone of the matrix of positions of the screen of the second size.

5. The method of playing a game as defined in claim 4 including the step of defining the second maximum number as less than the first maximum number.

6. The method of playing a game as defined in claim 4 including the further step of restricting movement of the target token to the positions within the band of the inner zone and those surrounded by the inner zone if the target token location is within the inner zone.

7. The method of playing a game as defined in claim 1 including the further steps of:

defining an innermost zone of positions in the matrix of positions of the screen of the second size; and further limiting movement of the target token to a third maximum number of positions if the target token location is within the innermost zone of the matrix of positions of the screen of the second size.

8. The method of playing a game as defined in claim 7 including the further step of restricting movement of the target token to the positions within the band of the innermost zone and those surrounded by the innermost zone if the target token is within the innermost zone.

9. The method of playing a game as defined in claim 1 including the steps of:

providing tracer tokens; and permitting the attacking player to mark the target tokens previous position by placement of a tracer token.

10. The method of playing a game as defined in claim 9 including the step of prohibiting the movement of the target token to a position previously occupied by the target token during the game.

* * * * *